US009223256B2

(12) United States Patent
Katoh et al.

(10) Patent No.: US 9,223,256 B2
(45) Date of Patent: Dec. 29, 2015

(54) INTERMEDIATE TRANSFER BELT METHOD FOR PRODUCING INTERMEDIATE TRANSFER BELT, AND IMAGE FORMING APPARATUS

(71) Applicants: Sayaka Katoh, Tokyo (JP); Jun Aoto, Kanagawa (JP); Kenichi Mashiko, Shizuoka (JP); Shinichi Nitta, Kanagawa (JP); Atsuo Hirai, Kanagawa (JP)

(72) Inventors: Sayaka Katoh, Tokyo (JP); Jun Aoto, Kanagawa (JP); Kenichi Mashiko, Shizuoka (JP); Shinichi Nitta, Kanagawa (JP); Atsuo Hirai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/025,164

(22) Filed: Sep. 12, 2013

(65) Prior Publication Data

US 2014/0079445 A1 Mar. 20, 2014

(30) Foreign Application Priority Data

Sep. 18, 2012 (JP) ..... 2012-203987
Jun. 21, 2013 (JP) ..... 2013-130485

(51) Int. Cl.
*G03G 15/01* (2006.01)
*G03G 15/16* (2006.01)

(52) U.S. Cl.
CPC ..... *G03G 15/162* (2013.01)

(58) Field of Classification Search
CPC ..... G03G 15/162
USPC ..... 399/302
See application file for complete search history.

(56) References Cited

U.S. PATENT DOCUMENTS

| | | | | |
|---|---|---|---|---|
| 4,910,556 | A * | 3/1990 | Namiki | 399/286 |
| 5,340,679 | A * | 8/1994 | Badesha et al. | 430/125.33 |
| 5,786,091 | A * | 7/1998 | Kurokawa et al. | 428/421 |
| 5,873,018 | A * | 2/1999 | Aoto et al. | 399/302 |
| 5,978,639 | A * | 11/1999 | Masuda et al. | 399/302 |
| 6,333,375 | B1 * | 12/2001 | Nakamura et al. | 524/394 |
| 2003/0026631 | A1 * | 2/2003 | Takahashi et al. | 399/302 |
| 2003/0035660 | A1 * | 2/2003 | Sugino et al. | 399/111 |
| 2010/0247169 | A1 * | 9/2010 | Hayashi | 399/302 |
| 2011/0177238 | A1 * | 7/2011 | Aoto et al. | 427/152 |
| 2011/0293824 | A1 * | 12/2011 | Aoto et al. | 427/201 |
| 2011/0305487 | A1 * | 12/2011 | Nakade | 399/308 |
| 2012/0082488 | A1 * | 4/2012 | Kubo et al. | 399/302 |
| 2012/0157277 | A1 * | 6/2012 | Moorlag et al. | 492/53 |
| 2012/0201578 | A1 | 8/2012 | Mashiko et al. | |
| 2012/0230740 | A1 | 9/2012 | Mikami et al. | |

(Continued)

FOREIGN PATENT DOCUMENTS

| | | | |
|---|---|---|---|
| EP | 2485094 | A1 | 8/2012 |
| EP | 2498136 | A1 | 9/2012 |

(Continued)

OTHER PUBLICATIONS

Machine translation of JP 2003117935 A.*

(Continued)

*Primary Examiner* — David Bolduc
(74) *Attorney, Agent, or Firm* — Cooper & Dunham LLP

(57) ABSTRACT

An intermediate transfer belt including a base layer, and an elastic layer on the base layer containing spherical particles on a surface thereof and containing an elastic layer ingredient, wherein the elastic layer contains a fatty acid in an amount of 0.001 parts by mass to 0.040 parts by mass relative to 100 parts by mass of the elastic layer ingredient.

2 Claims, 2 Drawing Sheets

(56) References Cited

U.S. PATENT DOCUMENTS

| | | | | |
|---|---|---|---|---|
| 2012/0262739 | A1 | 10/2012 | Kubo et al. | |
| 2012/0301191 | A1* | 11/2012 | Ito | 399/308 |
| 2013/0004212 | A1* | 1/2013 | Kubo et al. | 399/302 |
| 2013/0129395 | A1 | 5/2013 | Kubo et al. | |
| 2013/0334014 | A1* | 12/2013 | Mashiko et al. | 198/847 |
| 2014/0141252 | A1* | 5/2014 | Coggan et al. | 428/411.1 |

FOREIGN PATENT DOCUMENTS

| | | | | | |
|---|---|---|---|---|---|
| EP | 2523050 | A1 | | 11/2012 | |
| EP | 2595000 | A2 | | 5/2013 | |
| JP | 2003117935 | A | * | 4/2003 | B29C 43/28 |
| JP | 2004-198713 | | | 5/2004 | |
| JP | 2006-091497 | | | 4/2006 | |
| JP | 2006178232 | A | * | 7/2006 | |
| JP | 2014-26170 | | | 3/2014 | |

OTHER PUBLICATIONS

Machine translation of JP 2006178232 A.*

European Search Report dated Dec. 11, 2013 in corresponding European patent application No. 13 18 4848.3.

* cited by examiner

INTERMEDIATE TRANSFER BELT METHOD FOR PRODUCING INTERMEDIATE TRANSFER BELT, AND IMAGE FORMING APPARATUS

BACKGROUND OF THE INVENTION

1. Field of the Invention

The present invention relates to an intermediate transfer belt and a producing method of the intermediate transfer belt, and an image forming apparatus.

2. Description of the Related Art

Conventionally, in an electrophotographic image forming apparatus, an endless belt (seamless belt) has been used as a member in a variety of applications. Particularly, in full-color image forming apparatuses of recent years, an intermediate transfer belt system is used, in which developed images of four colors: yellow, magenta, cyan and black, are superposed on an intermediate transfer belt and then the superposed image is collectively transferred to a recording medium such as paper.

However, in such an intermediate transfer belt system, four developing devices are used for one photoconductor. Such an intermediate transfer belt system has a disadvantage that printing speed is low. For a system capable of attaining high speed printing, a four-series tandem system is used in which photoconductors for four colors are arranged in a tandem manner, and each color is continuously transferred on paper.

However, in this four-series tandem system, it is quite difficult to achieve sufficient positional accuracy upon superposing respective images because of changes of conditions of paper due to the working environments, forming images where the color images are not accurately superposed on top of each other.

Thus, recently, an intermediate transfer system has been predominately applied in the four-series tandem system.

Under such circumstances, characteristics required for the intermediate transfer belt have become strict to achieve, such as positional accuracy or high-speed transfer, but it is necessary to satisfy those characteristics.

The intermediate transfer belt has a primary transfer function of receiving a toner from an image bearing member and a secondary transfer function of delivering the toner to paper, in both of which transfer rate is needed to be improved. Especially, when the transfer rate is low in the secondary transfer, residual toner which has not transferred to paper remains on the intermediate transfer belt, which tends to cause image failure or filming.

In recent years, full-color electrophotographic image formation has increasingly been performed on various types of paper, such as commonly-used smooth paper, highly-smooth papers with slip properties (e.g., coated papers) and rough paper (e.g., recycled paper, embossed paper, Japanese paper and kraft paper). Generally, the secondary transfer rate in the case of printing to rough paper tends to be lower than that of to plain paper. This is because the intermediate transfer belt cannot completely contact with recessed portions on rough paper, so that toner may be insufficiently transferred to paper and remain on the intermediate transfer belt. In order to improve the followability to rough paper, various intermediate transfer belts have been proposed which include a base layer and a relatively flexible elastic layer laminated on the base layer.

Generally, the elastic layer contains elastic materials such as rubber or elastomer. However, there has been an attempt to use softer rubber for the elastic layer in order to improve transferability to rough paper.

When the intermediate transfer belt having the elastic layer which contains the softer rubber is produced and stored, a fatty acid such as stearic acid added as lubricant for improving processability at a kneading step of rubber may bloom onto the intermediate transfer belt over time (blooming). Especially, it has been known that the blooming easily occurs after storing under a high temperature and high humidity environment for a long period, followed by under a low temperature environment. When a fatty acid bloomed from the intermediate transfer belt adheres to an image bearing member, the image bearing member degenerates to thereby deteriorate image quality, which is problematic.

In order to solve the above problem, there have been conducted various studies regarding a method for preventing a fatty acid from blooming on the intermediate transfer belt. For example, there has been proposed a method in which a surface layer is formed on an elastic layer (see Japanese Patent Application Laid-Open (JP-A) Nos. 2006-091497 and 2004-198713).

However, in the above proposition, in the case where rubber hardness of the elastic layer is low, the surface layer is cracked or crinkled when the surface layer having relatively high hardness is formed on the elastic layer, which is problematic.

Meanwhile, when a surface layer having high flexibility is formed on a soft elastic layer, a surface of an intermediate transfer belt is deteriorated in releasability, so that toner cannot be efficiently released from the surface and the transfer rate of the toner from the intermediate transfer belt to paper tends to be lowered.

Accordingly, there is a need for providing an intermediate transfer belt which can prevent a fatty acid from blooming over time regardless of storage environment of the intermediate transfer belt, which allows a stable transfer for a long period, and which can achieve high-quality images.

SUMMARY OF THE INVENTION

The present invention aims to provide an intermediate transfer belt which can prevent a fatty acid from blooming over time regardless of storage environment of the intermediate transfer belt, which allows a stable transfer for long period, and which can achieve high-quality images.

An intermediate transfer belt of the present invention, which is a means of solving the above problems, is an intermediate transfer belt including a base layer, and an elastic layer on the base layer containing spherical particles on a surface thereof and containing an elastic layer ingredient, wherein the elastic layer contains a fatty acid in an amount of 0.001 parts by mass to 0.040 parts by mass relative to 100 parts by mass of the elastic layer ingredient.

The present invention can solve the above existing problems and achieve the above objects. That is, the present invention can provide an intermediate transfer belt which can prevent a fatty acid from blooming over time regardless of storage environment of the intermediate transfer belt, which allows a stable transfer for a long period, and which can achieve high-quality images.

DETAILED DESCRIPTION OF THE INVENTION

Intermediate Transfer Belt

Figure 1:
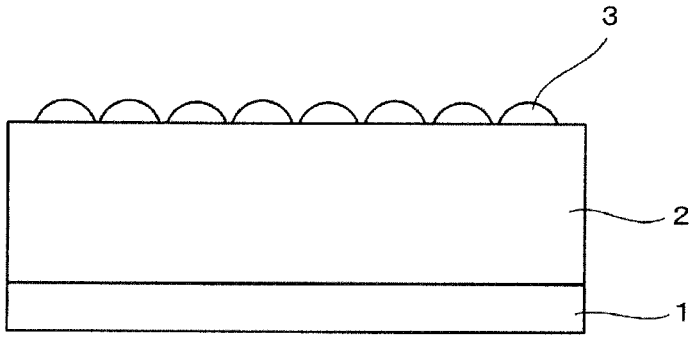
FIG. 1 is an explanatory view of one layer construction of an intermediate transfer belt of the present invention.

An intermediate transfer belt of the present invention includes a base layer and an elastic layer on the base layer containing spherical particles on a surface thereof, preferably consists of the base layer and the elastic layer. More preferably, the elastic layer is an outermost layer. That is, the intermediate transfer belt particularly preferably does not have a surface layer.

As used herein, the term "surface layer" means an outermost layer covering the entire surface of the elastic layer, having a thickness of 1 μm or more, and containing a composition which mainly contains a resin or an elastomer. Accordingly, spherical particles which are present on a surface of the elastic layer and a concavo-convex pattern formed by arranging spherical particles are encompassed in the elastic layer, that is, are not considered as the surface layer.

In the present invention, the intermediate transfer belt contains a fatty acid in an amount of 0.001 parts by mass to 0.040 parts by mass, preferably 0.005 parts by mass to 0.020 parts by mass relative to 100 parts by mass of the elastic layer ingredient. When the amount is more than 0.040 parts by mass, a fatty acid may be bloomed over time. When the amount is less than 0.001 parts by mass, rubber may become undesirably hard or energizing fatigue may be caused.

As used herein, the term "elastic layer ingredient" means ingredients constituting the elastic layer, that is, all ingredients contained in the elastic layer such as an elastic material (rubber ingredient), spherical particles, aluminium hydroxide, red phosphorus, vulcanizing agents, vulcanization promoters, ion conductive agents, or lubricants.

The fatty acid is preferably those being added to the elastic layer as, for example, lubricants and melting at a rubber-kneading temperature. Examples thereof include lauric acid, myristic acid, palmitic acid, and stearic acid.

Herein, the amount of a fatty acid contained in the elastic layer can be measured as follows:

(1) A prepared intermediate transfer belt is cut into about 1 cm×1 cm, and an elastic layer portion is peeled therefrom. The peeled elastic layer portion is weighed and immersed into 6 mL of methanol in a sealed vessel with a cap for 24 hours to extract a fatty acid from the elastic layer of the intermediate transfer belt.

(2) To the vessel, is added 2 mL of methanol hydrochloride (0.5 mol/L), followed by sealing the vessel with the cap again and heating at 80° C. for 2 hours in the vessel to thereby methylesterify the fatty acid. Thus, an extract of the elastic layer of the intermediate transfer belt can be obtained.

(3) The resultant extract is subjected to GC-MS measurement.

The GC-MS measurement is performed using GC-MS2010 (product of SHIMADZU CORPORATION) in the total ion mode in order to identify the fatty acid contained in the extract to thereby select an ion used. Then, the fatty acid is quantified in the SIM (selected ion monitor) mode.

A standard curve is drawn based on the area of the chromatogram in the SIM mode using a reagent corresponding to the detected fatty acid (for example, a stearic acid reagent having a purity of 99% or more in the case where stearic acid is detected).

(4) The amount of the fatty acid contained in the extract of the elastic layer of the intermediate transfer belt is determined from the standard curve. Based on the amount, the amount of the fatty acid (parts by mass) relative to 100 parts by mass of the elastic layer ingredient can be calculated.

The amount of the fatty acid contained in the elastic layer of the intermediate transfer belt can be controlled by adjusting a heating temperature and a heating time at a heat-treatment step in Method for producing intermediate transfer belt described below.

<Base Layer>

The base layer preferably contains a resin and an electrical resistance-controlling agent: more preferably, if necessary, further contains other ingredients.

—Resin—

The resin is not particularly limited and may be appropriately selected depending on the intended purpose. Examples thereof include fluorine resins such as polyvinylidene fluoride (PVDF) and ethylene-tetrafluoroethylene (ETFE) copolymer; polyimide resins and polyamideimide resins. Of these, polyimide resins or polyamideimide resins are particularly preferred from the viewpoints of mechanical strength (high elasticity) and heat resistance. Notably, polyimide resins and polyamideimide resins are below described in detail.

—Electrical Resistance-Controlling Agent—

The electrical resistance-controlling agent is not particularly limited and may be appropriately selected depending on the intended purpose. Examples thereof include a metal oxide, carbon black, an ion conductive agent and a conductive polymer. These may be used alone or in combination.

Examples of the metal oxide include zinc oxide, tin oxide, titanium oxide, zirconium oxide, aluminum oxide, silicon oxide, and products obtained by subjecting the above metal oxides to a surface treatment for improving dispersibility thereof.

Examples the carbon black include ketjen black, furnace black, acetylene black, thermal black and gas black.

Examples of the ion conductive agent include tetraalkyl ammonium salts, trialkylbenzyl ammonium salts, alkylsulfonic acid salts, alkylbenzenesulfonic acid salts, alkylsulfates, glycerin fatty acid esters, sorbitan fatty acid esters, polyoxyethylenealkylamine, esters of polyoxyethylene-aliphatic alcohols, alkylbetaine and lithium perchlorate.

The electrical resistance-controlling agent is preferably added so that the surface resistance thereof is $1\times10^{8}$ Ω/sq. to $1\times10^{14}$ Ω/sq. and the volume resistance thereof is $1\times10^{7}$ Ω·cm to $1\times10^{13}$ Ω·cm. However, the amount of the electrical resistance-controlling agent is too much, the base layer become brittle and fragile. Therefore, the amount is preferably selected so as not to interfere with mechanical strength. That is, in the case of a base layer of the intermediate transfer belt, a base layer having a good balance between electrical properties (surface resistance and volume resistance) and mechanical strength is preferably produced by using a base layer coating liquid containing appropriately adjusted amount of the resin ingredient (e.g., polyimide resin precursor or polyamideimide resin precursor) and the electrical resistance-controlling agent.

The amount of the electrical resistance-controlling agent is not particularly limited and may be appropriately selected depending on the intended purpose. In the case of carbon black, it is preferably 10% by mass to 25% by mass, more preferably 15% by mass to 20% by mass relative to the total solid content in the base layer coating liquid. In the case of metal oxides, it is preferably 1% by mass to 50% by mass, more preferably 10% by mass to 30% by mass relative to the total solid content in the base layer coating liquid. When the amount is below the lower limit, electrical resistance may be difficult to be uniform and may be varied greatly relative to any potential. When the amount is above the upper limit, the intermediate transfer belt may be deteriorated in mechanical strength.

The base layer coating liquid used for the base layer is prepared by mixing the resin selected from those described above; the electrical resistance-controlling agent; and, if necessary, additional additives such as dispersing aids, reinforcing agents, lubricants, heat conductive agents, or antioxidants. The base layer coating liquid is applied to a support (a mold for molding) as described below, and then subjected to a treatment such as a heat treatment to thereby obtain an endless belt.

The average thickness of the base layer is not particularly limited and may be appropriately selected depending on the intended purpose, but is preferably 30 μm to 150 μm, more preferably 40 μm to 80 μm. When the average thickness is less than 30 μm, the resultant belt may be fissile. When the average thickness is more than 150 μm, the resultant belt may be fragile.

The average thickness of the base layer can be measured using a contact-type (pointer-type) or eddy current type film thickness meter such as the electric micrometer (product of ANRITSU CORPORATION).

The polyimide resin (hereinafter may be referred to simply as "polyimide") and polyamideimide resin (hereinafter may be referred to simply as "polyamideimide") suitably used as a material of the base layer will be now specifically described.

—Polyimide—

The polyimide is not particularly limited and may be appropriately selected depending on the intended purpose, but aromatic polyimide is preferred. The aromatic polyimides are synthesized via a polyamic acid (polyimide precursor) which is obtained by reacting a commonly-known aromatic polycarboxylic anhydride (or a derivative thereof) with a commonly-known aromatic diamine. The polyimide, in particular, aromatic polyimide has a stiff main chain, and therefore is insoluble in a solvent and is not melted. Thus, in the above synthesis method for the polyimide resin, at first, an aromatic polycarboxylic anhydride is reacted with an aromatic diamine so as to synthesize a polyimide precursor (i.e., a polyamic acid or polyamide acid) which is soluble in an organic solvent. The thus-synthesized polyimide precursor is molded by various methods, followed by dehydration/cyclization (i.e., imidization) upon application of heat thereto or using a chemical method, to thereby synthesize a polyimide resin. Taking as an example a reaction for obtaining the aromatic polyimide, the outline thereof is shown in the following Reaction Scheme (1).

(1)

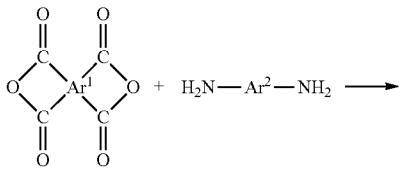

-continued

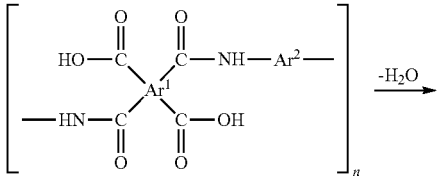

Polyimide precursor

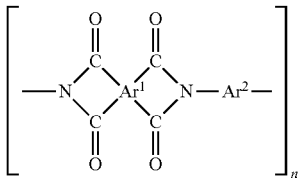

In Reaction Scheme (1), $Ar^1$ denotes a tetravalent aromatic residue containing at least one six-membered carbon ring; and $Ar^2$ denotes a divalent aromatic residue containing at least one six-membered carbon ring. Also, molecular ends in the Reaction Scheme are hydrogen atoms.

The aromatic polycarboxylic anhydride is not particularly limited and may be appropriately selected depending on the intended purpose. Examples thereof include ethylenetetracarboxylic dianhydride, cyclopentanetetracarboxylic dianhydride, pyromellitic dianhydride, 3,3',4,4'-benzophenonetetracarboxylic dianhydride, 2,2',3,3'-benzophenonetetracarboxylic dianhydride, 3,3',4,4'-biphenyltetracarboxylic dianhydride, 2,2',3,3'-biphenyltetracarboxylic dianhydride, 2,2-bis(2,3-dicarboxyphenyl)propane dianhydride, bis(3,4-dicarboxyphenyl)ether dianhydride, bis(3,4-dicarboxyphenyl)sulfone dianhydride, 1,1-bis(2,3-dicarboxyphenyl)ethane dianhydride, bis(2,3-dicarboxyphenyl)methane dianhydride, bis(3,4-dicarboxyphenyl)methane dianhydride, 2,2-bis(3,4-dicarboxyphenyl)-1,1,1,3,3,3-hexafluoropropane dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 1,2,3,4-benzenetetracarboxylic dianhydride, 3,4,9,10-perylenetetracarboxylic dianhydride, 2,3,6,7-anthracenetetracarboxylic dianhydride, and 1,2,7,8-phenanthrenetetracarboxylic dianhydride. These may be used alone or in combination.

The aromatic diamine which reacts with the aromatic polycarboxylic anhydride is not particularly limited and may be appropriately selected depending on the intended purpose. Examples thereof include m-phenylenediamine, o-phenylenediamine, p-phenylenediamine, m-aminobenzylamine, p-aminobenzylamine, 4,4'-diaminodiphenyl ether, 3,3'-diaminodiphenyl ether, 3,4'-diaminodiphenyl ether, bis(3-aminophenyl)sulfide, (3-aminophenyl)(4-aminophenyl)sulfide, bis(4-aminophenyl)sulfide, bis(3-aminophenyl)sulfide, (3-aminophenyl)(4-aminophenyl)sulfoxide, bis(3-aminophenyl)sulfone, (3-aminophenyl)(4-aminophenyl)sulfone, bis(4-aminophenyl)sulfone, 3,3'-diaminobenzophenone, 3,4'-diaminobenzophenone, 4,4'-diaminobenzophenone, 3,3'-diaminodiphenylmethane, 3,4'-diaminodiphenylmethane, 4,4'-diaminodiphenylmethane, bis[4-(3-aminophenoxy)phenyl]methane, bis[4-(4-aminophenoxy)phenyl]methane, 1,1-bis[4-(3-aminophenoxy)phenyl]ethane, 1,1-bis[4-(4-aminophenoxy)phenyl]ethane, 1,2-bis[4-(3-aminophenoxy)phenyl]ethane, 1,2-bis[4-(4-aminophenoxy)phenyl]ethane, 2,2-bis[4-(3-aminophenoxy)phenyl]propane, 2,2-bis[4-(4-aminophenoxy)phenyl]propane, 2,2-bis[4-(3-aminophenoxy)phenyl]butane, 2,2-bis[3-(3-aminophenoxy)phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy)benzene, 1,3-bis(4-aminophenoxy)benzene, 1,4-bis(3-aminophenoxy)benzene, 1,4-bis(4-aminophenoxy)benzene, 4,4'-bis(3-aminophenoxy)biphenyl, 4,4'-bis(4-aminophenoxy)biphenyl, bis[4-(3-aminophenoxy)phenyl]ketone, bis[4-(4-aminophenoxy)phenyl]ketone, bis[4-(3-aminophenoxy)phenyl]sulfide, bis[4-(4-aminophenoxy)phenyl]sulfide, bis[4-(3-aminophenoxy)phenyl]sulfoxide, bis[4-(4-aminophenoxy)phenyl]sulfoxide, bis[4-(3-aminophenoxy)phenyl]sulfone, bis[4-(4-aminophenoxy)phenyl]sulfone, bis[4-(3-aminophenoxy)phenyl]ether, bis[4-(4-aminophenoxy)phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenyl ether, 4,4'-bis[3-(3-aminophenoxy)benzoyl]diphenyl ether, 4,4'-bis[4-(4-amino-α,α-dimethylbenzyl)phenoxy]benzophenone, 4,4'-bis[4-(4-amino-α,α-dimethylbenzyl)phenoxy]diphenyl sulfone, bis[4-{4-(4-aminophenoxy)phenoxy}phenyl]sulfone, 1,4-bis[4-(4-aminophenoxy)phenoxy]-α,α-dimethylbenzyl]benzene and 1,3-bis[4-(4-aminophenoxy)-α,α-dimethylbenzyl]benzene. These may be used alone or in combination. Of these, at least 4,4'-diaminodiphenyl ether is preferably used as one ingredient.

A polyimide precursor (polyamic acid) can be obtained by polymerizing approximately equimolar amounts of the aromatic polycarboxylic anhydride and the diamine in an organic polar solvent. Hereinafter, a production method of polyamic acid will be explained in detail.

Notably, the organic polar solvent used in the polymerization reaction of polyamic acid is not particularly limited and may be appropriately selected depending on the intended purpose as long as it dissolves polyamic acid. Examples thereof include sulfoxide solvents such as dimethylsulfoxide and diethylsulfoxide; formamide solvents such as N,N-dimethylformamide and N,N-diethylformamide; acetamide solvents such as N,N-dimethylacetamide and N,N-diethylacetamide; pyrrolidone solvents such as N-methyl-2-pyrrolidone and N-vinyl-2-pyrrolidone; phenol solvents such as phenol, o-, m- or p-cresol, xylenol, halogenated phenol and catechol; ether solvents such as tetrahydrofuran, dioxane and dioxolane; alcohol solvents such as methanol, ethanol and butanol; cellosolve solvents such as butyl cellosolve; or hexamethylphosphoramide and γ-butyrolactone. These may be used alone or in combination. Of these, N,N-dimethylacetamide and N-methyl-2-pyrrolidone are particularly preferred.

One employable method for producing the polyimide precursor is as follows. Firstly, in an inert gas (such as argon gas and nitrogen gas) environment, one or more diamines are dissolved or dispersed into a slurry in the organic solvent. To the resultant solution or slurry, is added at least one aromatic polycarboxylic anhydride or a derivative thereof, which may be in the form of solid, solution in which it is dissolved in the organic solvent, or slurry, so that a ring opening polymerization-addition reaction involving heat generation is induced, and as a result the viscosity of the solution or slurry rapidly increases, to thereby produce a high-molecular-weight polyamic acid solution. The reaction temperature is not particularly limited and may be appropriately selected depending on the intended purpose. It is preferably −20° C. to 100° C., more preferably 60° C. or lower. The reaction time is not particularly limited and may be appropriately selected depending on the intended purpose. It is preferably about 30 min to about 12 hours.

The method for producing the polyimide precursor is only one example and the additions may be performed with the order reversed. That is, the aromatic polycarboxylic anhydride or a derivative thereof may be firstly dissolved or dispersed in an organic solvent and then the diamine may be added thereto. The diamine may be added in the form of solid, solution in which it is dissolved in the organic polar solvent, or slurry. Accordingly, the order of mixing acid dianhydrides and diamines is not limited. Further, aromatic tetracarboxylic dianhydrides and aromatic diamines may be added to the organic polar solvent simultaneously to thereby allow to react.

As described above, a polyimide precursor solution containing polyamic acid uniformly dissolved in an organic polar solvent can be obtained by polymerizing an aromatic polycarboxylic anhydride or a derivative thereof and an aromatic diamine at about equimolar in the organic polar solvent.

The polyimide precursor solution (polyamic acid solution) may be those synthesized as described above. However, a commercially available product of a so-called polyimide varnish, in which a polyamic acid composition is dissolved in an organic solvent, can be used. Examples thereof include TORENEES (product of Toray Industries INC.), U-VARNISH (product of Ube Industries, Ltd.), RIKA COAT (product of New Japan Chemical Co., Ltd.), OPTOMER (product of JSR Corporation), SE812 (product of Nissan Chemical Industries, Ltd.) and CRC8000 (product of Sumitomo Bakelite Co., Ltd.).

A filler is optionally mixed with or dispersed in the polyamic acid solution to thereby prepare a coating liquid used for forming the base layer, and the resultant coating solution is applied to a support (a mold for molding) followed by heating to thereby convert the polyamic acid (polyimide precursor) to a polyimide (imidization).

The polyamic acid can be imidized by a heating method (1) or a chemical method (2).

The heating method (1) is a method in which a polyamic acid is heated at 200° C. to 350° C. to thereby convert to a polyimide. This is a simple and practical method for obtaining a polyimide (polyimide resin).

The chemical method (2) is a method in which a polyamic acid is allowed to react with a dehydration ring forming reagent (e.g., a mixture of a carboxylic anhydride and a tertiary amine) and then heating so as to complete imidization. This method is more complex and expensive compared to the heating method (1). Therefore, the heating method (1) has been usually employed.

Notably, in order to obtain intrinsic properties of polyimide (i.e., durability (mechanical strength) and heat resistance), the polyamic acid is preferably heated to a temperature equal to or higher than the glass transition temperature of a resultant polyimide so as to complete imidization.

The progress of the imidization (the degree of the imidization) can be determined by a conventionally used measurement method for imidization ratio.

Examples of the measurement method for imidization ratio include a nuclear magnetic resonance (NMR) method in which the imidization ratio is determined on the basis of an integral ratio of $^1$H of the amide group observed at about 9 ppm to about 11 ppm to $^1$H of the aromatic ring observed at about 6 ppm to about 9 ppm, a Fourier transform infrared spectrophotometric (FT-IR) method, a method of quantifying water formed as a result of ring formation of imides, and a method in which the amount of carboxylic acid is determined by a neutralization titration method.

Of these, a Fourier transform infrared spectrophotometric (FT-IR) method is the most commonly used.

In the Fourier transform infrared spectrophotometric (FT-IR) method, the imidization ratio is, for example, defined as in the following Equation (a). In the Equation (a), (A) denotes an amount by mole of the imide group determined in the heating step (i.e., the imidization step) and (B) denotes an amount by mole of the imide group when the polyamic acid is completely (100%) imidized (theoretical value).

$$\text{Imidization ratio}(\%)=[(A)/(B)]\times 100 \quad (a)$$

An amount by mole of the imide group in this definition can be determined from the absorbance ratios of the characteristic absorption of the imide group measured by the FT-IR method. For example, imidization ratio may be determined using the following absorbance ratios as representative characteristic absorptions.

(1) a ratio of the absorbance at 725 $cm^{-1}$ which is attributed to an imide (caused by the bending vibration of the C═O group of an imide ring) to the absorbance at 1,015 $cm^{-1}$ which is attributed to a benzene ring;

(2) a ratio of the absorbance at 1,380 $cm^{-1}$ which is attributed to an imide (caused by the bending vibration of the C—N group of an imide ring) to the absorbance at 1,500 $cm^{-1}$ which is attributed to a benzene ring;

(3) a ratio of the absorbance at 1,720 $cm^{-1}$ which is attributed to an imide (caused by the bending vibration of the C═O group of an imide ring) to the absorbance at 1,500 $cm^{-1}$ which is attributed to a benzene ring; and (4) a ratio of the absorbance at 1,720 $cm^{-1}$ which is attributed to an imide to the absorbance at 1,670 $cm^{-1}$ which is attributed to an amide group (the interaction of the bending vibration of a N—H group and the stretching vibration of a C—N group of an amide group).

Alternatively, when it is confirmed that the multiple absorption bands attributed to an amide group at 3,000 $cm^{-1}$ to 3,300 $cm^{-1}$ have disappeared, the reliability of completion of the imidization is further enhanced.

—Polyamideimide—

The polyamideimide is a resin containing, in the molecular skeleton thereof, both an imide group which is rigid and an amide group which imparts flexibility to the resin. The polyamideimide used in the present invention may be those having a generally known structure.

Examples of common methods for synthesizing the polyamideimide resin include an acid chloride method (a): a known method in which a halide compound, of which the most representative example is chloride compound, derived from a trivalent carboxylic acid having an acid anhydride group is reacted in a solvent with a diamine to thereby produce a polyamideimide resin (see, for example, Japanese Patent Application Publication (JP-B) No. 42-15637); and a isocyanate method (b): a known method in which a trivalent derivative having an acid anhydride group and a carboxylic acid is reacted in a solvent with an aromatic polyisocyanate to thereby produce a polyimideamide resin (see, for example, JP-B No. 44-19274), both of which may be used. Each of the above methods now will be explained.

(a) Acid Chloride Method

The halide compound derived from a trivalent carboxylic acid having an acid anhydride group is not particularly limited and may be appropriately selected depending on the intended purpose. Examples thereof include a compound represented by the following General Formulas (2) and (3).

(2)

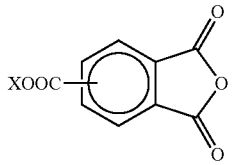

In General Formula (2), X denotes a halogen atom.

(3)

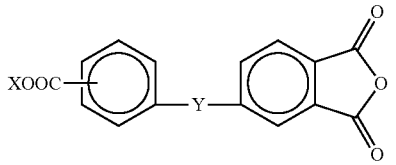

In General Formula (3), X denotes a halogen atom and Y denotes —$CH_2$—, —CO—, —$SO_2$— or —O—.

The halogen atom in each of the above General Formulas is not particularly limited and may be appropriately selected depending on the intended purpose, but preferably is chloride. Examples of the derivatives thereof include acid chlorides of polycarboxylic acids such as terephthalic acid, isophthalic acid, 4,4'-biphenyldicarboxylic acid, 4,4'-biphenyletherdicarboxyulic acid, 4,4'-biphenylsulfonedicarboxylic acid, 4,4'-benzophenonedicarboxylic acid, pyromellitic acid, trimellitic acid, 3,3',4,4'-benzophenonetetracarboxylic acid, 3,3',4,4'-biphenylsulfonetetracarboxylic acid, 3,3',4,4'-biphenyltetracarboxylic acid, adipic acid, sebacic acid, maleic acid, fumaric acid, dimer acid, stilbenedicarboxylic acid, 1,4-cyclohexanedicarboxylic acid and 1,2-cyclohexanedicarboxylic acid. These may be used alone or in combination.

The diamine is not particularly limited and may be appropriately selected depending on the intended purpose. Examples thereof include aromatic diamines, aliphatic diamines, and alicyclic diamines. Of these, preferred are aromatic diamines.

The aromatic diamine is not particularly limited and may be appropriately selected depending on the intended purpose. Examples thereof include m-phenylenediamine, p-phenylenediamine, oxydianiline, methylenediamine, hexafluoroisopropylidene diamine, diamino-m-xylylene, diamino-p-xylylene, 1,4-napthalenediamine, 1,5-napthalenediamine, 2,6-napthalenediamine, 2,7-napthalenediamine, 2,2'-bis-(4-aminophenyl)propane, 2,2'-bis-(4-aminophenyl)hexafluoropropane, 4,4'-diaminodiphenyl sulfone, 4,4'-diaminodiphenyl ether, 3,3'-diaminodiphenyl sulfone, 3,3'-diaminodiphenyl ether, 3,4-diaminobiphenyl, 4,4'-diaminobenzophenone, 3,4-diaminodiphenyl ether, isopropylidenedianiline, 3,3'-diaminobenzophenone, o-tolidine, 2,4-tolylenediamine, 1,3-bis-(3-aminophenoxy)benzene, 1,4-bis-4-aminophenoxy)benzene, 1,3-bis-(4-aminophenoxy)benzene, 2,2-bis-[4-(4-aminophenoxy/phenyl]propane, bis-[4-(4-aminophenoxy)phenyl]sulfone, bis-[4-(3-aminophenoxy)phenyl]sulfone, 4,4'-bis-(4-aminophenoxy)biphenyl, 2,2'-bis-[4-(4-aminophenoxy/phenyl]hexafluoropropane, 4,4'-diaminodiphenyl sulfide and 3,3'-diaminodiphenyl sulfide. These may be used alone or in combination.

The siloxane compound having amino groups at both ends thereof can be used to obtain silicone-modified polyamideimide: such as 1,3-bis(3-aminopropyl)-1,1,3,3-tetramethyldisiloxane, α,ω-bis(3-aminopropyl)polydimethylsiloxane, 1,3-bis(3-aminophenoxymethyl)-1,1,3,3-tetramethyldisiloxane, α,ω-bis(3-aminophenoxymethyl)polydimethylsiloxane, 1,3,-bis(2-(3-aminophenoxy)ethyl)-1,1,3,3-tetramethyldisiloxane, α,ω-bis(2-(3-aminophenoxy)ethyl)polydimethylsiloxane, 1,3-bis(3-(3-aminophenoxy)propyl)-1,1,3,3-tetramethyldisiloxane and α,ω-bis(3-(3-aminophenoxy)propyl) polydimethylsiloxane are used as the diamines.

Similar to the polyimide resin, the polyamideimide (polyamideimide resin) of the present invention can be obtained by the acid chloride method as follows. At first, the halide compound derived from a trivalent carboxylic acid having an acid anhydride group and the diamine are dissolved in an organic polar solvent where they are allowed to react with each other at a low temperature of 0° C. to 30° C. to thereby produce a polyamideimide precursor (polyamide-amic acid).

Similar to the polyimide, the organic polar solvent is not particularly limited and may be appropriately selected depending on the intended purpose as long as it dissolves polyamic acid. Examples thereof include formamide solvents (e.g., sulfoxide solvents such as dimethylsulfoxide and diethylsulfoxide, N,N-dimethylformamide and N,N-diethylformamide), acetamide solvents (e.g., N,N-dimethylacetamide and N,N-diethylacetamide), pyrrolidone solvents (e.g., N-methyl-2-pyrrolidone and N-vinyl-2-pyrrolidone), phenol solvents (e.g., phenol, o-, m- or p-cresol, xylenol, halogenated phenol and catechol), ether solvents (e.g., tetrahydrofuran, dioxane and dioxolane), alcohol solvents (e.g., methanol, ethanol and butanol), cellosolve solvents (e.g., butyl cellosolve), hexamethylphosphoramide and γ-butyrolactone. These may be used alone or in combination. Of these, N,N-dimethylacetamide and N-methyl-2-pyrrolidone are particularly preferred.

The polyamic acid is converted (imidized) to a polyimide by applying the resultant polyamide-polyamic acid solution to a support (a mold for molding) followed by heating.

Examples of the imidization method include a method in which dehydration ring closing is performed through thermally treating and a method in which ring closing is chemically performed using a catalyst for dehydration ring closing. In the case where dehydration ring closing is performed through thermally treating, the reaction temperature is not particularly limited and may be appropriately selected depending on the intended purpose. It is preferably 150° C. to 400° C., more preferably 180° C. to 350° C. The reaction time is not particularly limited and may be appropriately selected depending on the intended purpose. It is preferably 30 sec to 10 hours, more preferably 5 min to 5 hours. In the case where the catalyst for dehydration ring closing is used, the reaction temperature is not particularly limited and may be appropriately selected depending on the intended purpose. It is preferably 0° C. to 180° C., more preferably 10° C. to 80° C. The reaction time is not particularly limited and may be appropriately selected depending on the intended purpose. It is preferably several tens minutes to several days, more preferably 2 hours to 12 hours. Examples of the catalyst for dehydration ring closing include acid anhydrides of acetic acid, propionic acid, butylic acid and benzoic acid.

(b) Isocyanate Method

The compound derived from a trivalent carboxylic acid having an acid anhydride group may be compounds represented by the following General Formulas (4) and (5).

(4)

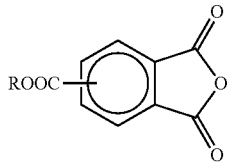

In the General Formula (4), R denotes a hydrogen atom, a C1-C10 alkyl group or a phenyl group.

(5)

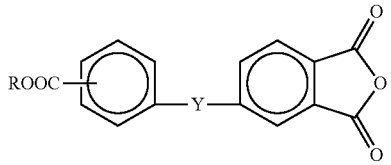

In the General Formula (5), R denotes a hydrogen atom, a C1-C10 alkyl group or a phenyl group and Y denotes —$CH_2$—, —CO—, —$SO_2$— or —O—.

Any compounds represented by the General Formulas may be used. However, trimellitic anhydride is most commonly used. The compound derived from a trivalent carboxylic acid having an acid anhydride group may be used alone or in combination.

The aromatic polyisocyanate used in the isocyanate method is not particularly limited and may be appropriately selected depending on the intended purpose. Examples thereof include 4,4'-diphenylmethane diisocyanate, tolylene diisocyanate, xylylene diisocyanate, 4,4'-diphenylether diisocyanate, 4,4'-[2,2-bis(4-phenoxyphenyl)propane]diisocyanate, biphenyl-4,4'-diisocyanate, biphenyl-3,3'-diisocyanate, biphenyl-3,4'-diisocyanate, 3,3'-dimethylbiphenyl-4,4'-diisocyanate, 2,2'-dimethylbiphenyl-4,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate and naphthalene-2,6-diisocyanate. These may be used alone or in combination.

The following may be used if necessary: aliphatic or alicyclic isocyanates such as hexamethylene diisocyanate, 2,2,4-trimethylhexamethylene diisocyanate, isophorone diisocyanate, 4,4'-dicyclohexylmethane diisocyanate, transcyclohexane-1,4-diisocyanate, hydrogenated m-xylene diisocyanate and lysine diisocyanate, and/or tri- or higher functional polyisocyanates.

The polyamideimide precursor is converted to a polyamideimide by applying to a support a solution containing the polyamideimide precursor in which the compound derived from a trivalent carboxylic acid having an acid anhydride group and the aromatic polyisocyanate are dissolved in an organic polar solvent, followed by heating. In this method, the polyamideimide precursor is directly converted to the polyamideimide without via polyamic acid with carbon dioxide being generated. As one example of the conversion in the case where trimellitic anhydride and an aromatic isocyanate are used is shown in the following Reaction Scheme (6).

(6)

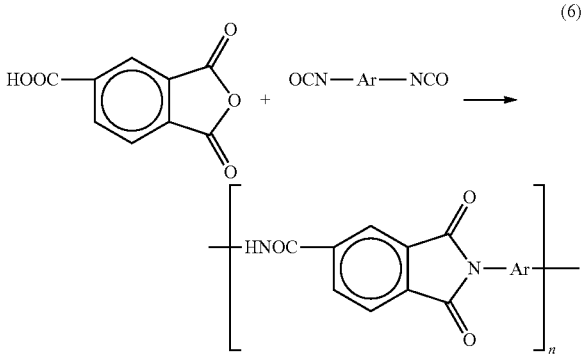

In the Reaction Scheme (6), Ar denotes an aromatic group.

The polyimide and polyamideimide are usually used alone, but may be used in combination with those selected considering compatibility therewith. Also, a copolymer having a polyimide repeat unit and a polyamideimide repeat unit may be used.

<Elastic Layer>

The elastic layer contains spherical particles on a surface thereof and contains an elastic layer ingredient.

The elastic layer refers to a layer which has a microrubber hardness of 90° or less under a environment of 25° C. and 50% RH. The microrubber hardness may be measured by a commercially available microrubber hardness meter such as MD-1 (product of KOBUNSHI KEIKI CO., LTD.).

—Elastic Layer Ingredient—

The elastic layer ingredient refers to ingredients constituting the elastic layer, that is, all ingredients contained in the elastic layer such as an elastic material (rubber ingredient), spherical particles, aluminium hydroxide, red phosphorus, vulcanizing agents, vulcanization promoters, ion conductive agents, or lubricants.

The elastic material is not particularly limited and may be appropriately selected depending on the intended purpose. Examples thereof include elastomer or rubber.

—Elastomer—

The elastomer is not particularly limited and may be appropriately selected depending on the intended purpose. Examples thereof include thermoplastic elastomers and thermosetting elastomers. These may be used alone or in combination.

The thermoplastic elastomer is not particularly limited and may be appropriately selected depending on the intended purpose. Examples thereof include polyester elastomers, polyamide elastomers, polyether elastomers, polyurethane elastomers, polyolefin elastomers, polystyrene elastomers, polyacrylic elastomers, polydiene elastomers, silicone-modified polycarbonate elastomers and fluorine copolymer elastomers.

The thermosetting elastomer is not particularly limited and may be appropriately selected depending on the intended purpose. Examples thereof include polyurethane elastomers, silicone-modified epoxy elastomers and silicone-modified acrylic elastomers.

—Rubber—

The rubber is not particularly limited and may be appropriately selected depending on the intended purpose. Examples thereof include isoprene rubbers, styrene rubbers, butadiene rubbers, nitrile rubbers, hydrogenated nitrile rubbers, ethylenepropylene rubbers, butyl rubbers, silicone rubber, chloroprene rubbers, acrylic rubbers, chlorosulfonated polyethylenes, fluorine rubbers, urethane rubbers, hydrin rubbers, acrylonitrile butadiene rubbers and vulcanized rubbers. These may be used alone or in combination. Of these, acrylic rubbers and hydrogenated nitrile rubbers are preferred from the viewpoint of being capable of obtaining properties which are required for followability to paper such as hardness, elastic modulus or creep property.

—Surface of Elastic Layer—

The elastic layer contains spherical particles on a surface thereof. The spherical particles are embedded in at least a part of a surface of the elastic layer. The spherical particles may be partially exposed.

The surface of the elastic layer preferably has a concavo-convex pattern formed by arranging the spherical particles in a plane direction from the viewpoint of transferability to paper.

The arrangement of the spherical particles is not particularly limited and may be appropriately selected depending on the intended purpose. Examples thereof include an arrangement in which the spherical particles are arranged on the elastic layer to form a single layer in the thickness direction and an arrangement in which two or more of the spherical particles are stacked on top of each other in the thickness direction.

Of these, preferred is an arrangement in which the spherical particles are arranged on the elastic layer to form a single layer in the thickness direction. This is because the arrangement can easily be attained by directly applying the spherical particles on the elastic layer and leveling the spherical particles to thereby uniformly arrange the spherical particles. In addition, the arrangement can stably form high-quality images.

Meanwhile, in the arrangement in which two or more of the spherical particles are stacked on top of each other in the thickness direction, the spherical particles are ununiformly distributed. As a result, due to the electrical resistance of the spherical particles, electrical characteristics on a surface of the intermediate transfer belt also become ununiform, potentially leading to image failures. Specifically, the electrical resistance becomes high in a region where a large amount of the spherical particles Yes, and surface potential is generated in this region due to residual charges. This makes the surface potential ununiform on the intermediate transfer belt surface to thereby cause the difference in image density between this region and the neighboring regions, resulting in that image failures may be visualized.

—Spherical Particles—

The spherical particles are not particularly limited and may be appropriately selected depending on the intended purpose. Examples thereof include spherical particles mainly containing a rubber or a resin (e.g., acrylic resin, melamine resin, polyamide resin, polyester resin, silicone resin and fluorine resin); hollow or porous spherical particles obtained by subjecting the above spherical particles to a surface treatment with different materials; spherical particles obtained by coating with a hard resin the surfaces of the particles made of a rubber material; and spherical silicone resin particles or spherical fluorine resin particles produced by controlling their shape upon a polymerization.

Of these, preferred are spherical silicone resin particles or spherical fluorine resin particles produced by controlling their shape upon a polymerization, because they have lubricity and thus can impart, to the resultant intermediate transfer belt, high releaseability to toner particles and high abrasion resistance. The spherical particles are preferably spherical to the greatest extent possible.

The spherical particles refer to particles which have an average particle diameter of 100 μm or less, which have a truly spherical shape, which do not dissolve in an organic solvent, and in which the temperature at which 3% thereof thermally decompose is 200° C. or higher.

The spherical particles are not particularly limited and may be an appropriately synthesized product or a commercially available product. Examples of the commercially available product include silicone particles (product of Momentive Performance Materials Inc., trade names "TOSPEARL 120," "TOSPEARL 145," or "TOSPEARL 2000B") and acryl particles (product of SEKISUI PLASTICS CO., LTD., trade name "TECHNO POLYMER MBX-SS").

The volume average particle diameter of the spherical particles is not particularly limited and may be appropriately selected depending on the intended purpose. It is preferably 0.1 μm to 10.0 μm, more preferably 0.3 μm to 3.0 μm. Also, it is preferably monodispersed; i.e., sharply distributed.

The volume average particle diameter can be measured by commercially available particle size analyzers such as NANOTRAC UPA-150EX (product of NIKKISO CO., LTD.).

Examples of the elastic layer ingredient include, in addition to the elastic material and the spherical particles, lubricants, electrical resistance-controlling agents, flame retardants for imparting flame retardancy, antioxidants, reinforcing agents, fillers and vulcanization promoters.

—Lubricant—

The lubricant is not particularly limited and may be appropriately selected depending on the intended purpose, but preferably is a fatty acid. The fatty acid may be those described above.

—Electrical Resistance-Controlling Agent—

The electrical resistance-controlling agent is not particularly limited and may be appropriately selected depending on the intended purpose. However, because carbon black and metal oxides impair flexibility of the resultant product, the amounts of them are preferably lowered. Preferably, ion conductive agents or conductive polymers are used.

The average thickness of the elastic layer is not particularly limited and may be appropriately selected depending on the intended purpose. It is preferably 50 μm to 1,000 μm, more preferably 100 μm to 500 μm. When the average thickness of the elastic layer is smaller than 50 μm, the followability to surface irregularities of a recording medium such as paper and the transfer pressure-reducing effect may be lowered. When the average thickness of the elastic layer exceeds 1,000 μm, the film becomes heavier. As a result, the film may easily be warped and unstable in running. Further, cracks tend to occur at part of the belt which is curved so as to be wound around the rollers in a stretched manner.

The average thickness is an average value of thicknesses measured at any 10 points. Notably, the thickness may be measured by observing a cross-sectional surface of an intermediate transfer belt under a scanning electron microscope VE-7800 (product of KEYENCE CORPORATION).

The electrical resistance of the elastic layer is not particularly limited and may be appropriately selected depending on the intended purpose. For example, the electrical resistance of the elastic layer is preferably $1\times10^{8}$ Ω/sq. to $1\times10^{13}$ Ω/sq. as surface resistance, and $1\times10^{7}$ Ω·cm to $1\times10^{13}$ Ω·cm as volume resistance.

—Method for Forming Elastic Layer—

The method for forming the elastic layer is not particularly limited and may be appropriately selected depending on the intended purpose. Examples thereof include a method in which the elastic layer is formed on the base layer through, for example, injection molding or extrusion molding and a method in which an elastic layer-coating liquid containing the elastic layer ingredient is applied onto the base layer to form the elastic layer. The above methods will be described in detail in Method for producing intermediate transfer belt.

—Method for Forming Surface of Elastic Layer—

Example of a method for forming a surface of the elastic layer includes a method in which the spherical particles are applied onto the elastic layer of the belt obtained by laminating the elastic layer on the base layer using the method for forming the elastic layer to thereby form a uniform concavo-convex pattern on a surface of the elastic layer, followed by heating and curing at a predetermined temperature for a predetermined time while being rotated. The above method will be described in detail in Method for producing intermediate transfer belt.

The microrubber hardness of the intermediate transfer belt is not particularly limited and may be appropriately selected depending on the intended purpose, but is preferably 60° or less, more preferably 20° to 40° from the viewpoints of followability to paper and deformability of the belt.

The microrubber hardness may be measured by, for example, a microrubber hardness meter (MD-1, product of KOBUNSHI KEIKI CO., LTD.).

The intermediate transfer belt is preferably an endless belt, i.e., a seamless belt. The circumference of the intermediate transfer belt in the case where the intermediate transfer belt is an endless belt is not particularly limited and may be appropriately selected depending on the intended purpose. However, it is preferably 1,000 mm or more, more preferably 1,100 mm to 3,000 mm.

(Method for Producing Intermediate Transfer Belt)

A method for producing an intermediate transfer belt of the present invention is a method for producing the intermediate transfer belt of the present invention, and includes at least an elastic layer-forming step and a heat treatment step, and preferably a base layer-forming step; and, if necessary, further includes other steps.

<Base Layer-Forming Step>

The base layer-forming step is a step of forming a base layer using a base layer coating liquid. It is not particularly limited and may be appropriately selected depending on the intended purpose. Example thereof includes a method exemplified in the description regarding the base layer.

<Elastic Layer-Forming Step>

The elastic layer-forming step is a step of forming an elastic layer containing spherical particles on a surface thereof by applying onto a base layer an elastic layer-coating liquid containing an elastic layer ingredient and then arranging spherical particles thereon. It includes the following elastic layer-forming treatment and elastic layer surface-forming treatment.

—Elastic Layer-Forming Treatment—

The elastic layer-forming treatment is not particularly limited and may be appropriately selected depending on the intended purpose. Examples thereof include a method in which the elastic layer is formed on the base layer through, for example, injection molding or extrusion molding and a method in which an elastic layer-coating liquid containing the elastic layer ingredient is applied onto the base layer to form the elastic layer.

One example of the elastic layer-forming treatment will next be described in detail.

While the endless base layer in which a cylindrical metal mold is inserted is being slowly rotated, a coating liquid containing an elastic layer ingredient is uniformly coated or flow-cast on the entire outer surface of the cylindrical metal mold with a liquid-supplying device such as a nozzle or a dispenser (to thereby form a coat film). Then, the rotation speed is increased to a predetermined value, at which the rotation speed is maintained constant for a desired period. Thereafter, the resultant film is sufficiently leveled to form an elastic layer. Notably, if necessary, heating may be performed during the rotation.

—Elastic Layer Surface-Forming Treatment—

Example of the elastic layer surface-forming treatment includes a method in which the spherical particles are applied onto the elastic layer of the intermediate transfer belt obtained by laminating the elastic layer on the base layer using the elastic layer-forming treatment to thereby form a uniform concavo-convex pattern on a surface of the elastic layer, followed by heating and curing at a predetermined temperature for a predetermined time while being rotated.

One example of the elastic layer surface-forming treatment will next be described in detail.

Figure 3:
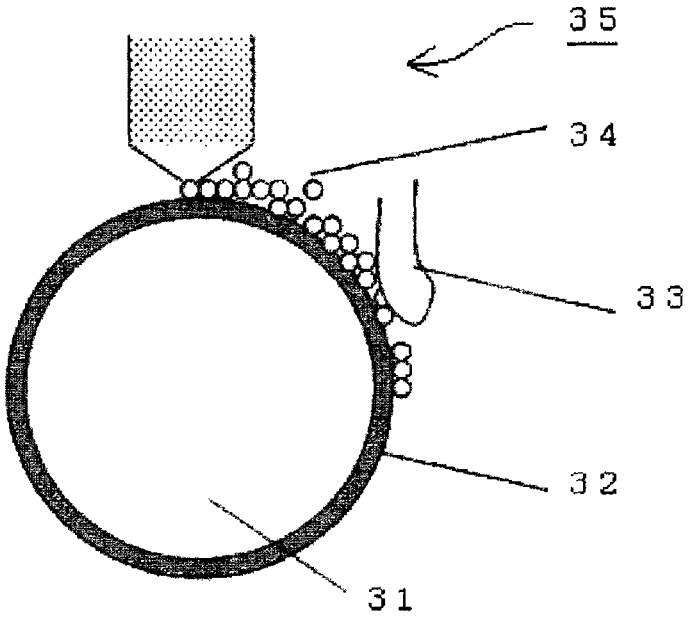
FIG. 3 shows an exemplary manner in which spherical particles are uniformly embedded in a surface of an elastic layer.

As shown in FIG. 3, after a powder-supplying device 35 and a press member 33 have been set, spherical particles 34 are uniformly applied onto the elastic layer surface from the powder-supplying device 35 while being rotated. Then, the press member 33 is pressed against the thus-applied spherical particles 34 on the elastic layer surface at a constant pressure. Pressing by the press member embeds the spherical particles 34 in the elastic layer of a belt 32 obtained by laminating the elastic layer on the base layer which has been formed on a metal drum 31 while removing the extra spherical particles 34 to thereby form a uniform concavo-convex pattern on a surface of the elastic layer. The resultant is heated and cured at a predetermined temperature for a predetermined time while being rotated.

When the spherical particles used for forming the elastic layer having a concavo-convex pattern on a surface thereof are monodispersed spherical particles, a uniform particle monolayer can be formed through only such a leveling step using the press member.

<Heat Treatment Step>

The heat treatment step is a step of vulcanizing the elastic layer and then heating. Notably, the heat treatment may be referred to as a post-cure treatment.

A heating condition in the heat treatment step is not particularly limited and may be appropriately adjusted considering the type of an elastic layer ingredient and a weight loss of a fatty acid. The heating is preferably performed under any of the following conditions: at 150° C. or more but less than 155° C. for 8 hours or more, at 155° C. or more but less than 165° C. for 5 hours or more, at 165° C. or more but less than 175° C. for 4 hours or more, and at 175° C. to 180° C. for 3 hours or more, which may adjust the amount of a fatty acid contained in an intermediate transfer belt so as to fall within a range of 0.001 parts by mass to 0.040 parts by mass relative to 100 parts by mass of the elastic layer ingredient.

Notably, the heat treatment step is not particularly limited and may be appropriately selected, but is preferably performed in the air using driers such as hot air-circulating driers.

The fatty acid contained in the elastic layer is volatilized and eliminated from the elastic layer by heating, but excessive heating causes a decrease of rubber elasticity and a deterioration of energizing fatigue, which have a great effect on image quality. Therefore, a heating temperature and a heating time should be well considered.

A heating condition in the heat treatment step is not particularly limited and may be appropriately adjusted considering the type of an elastic layer ingredient and a weight loss of a fatty acid. The heating is preferably performed under any of the following conditions: at 150° C. or more but less than 155° C. for 8 hours or more, at 155° C. or more but less than 165° C. for 5 hours or more, at 165° C. or more but less than 175° C. for 4 hours or more, and at 175° C. to 180° C. for 3 hours or more, which may adjust the amount of a fatty acid contained in an intermediate transfer belt so as to 0.020 parts by mass or less relative to 100 parts by mass of the elastic layer ingredient.

Notably, the heat treatment step is not particularly limited and may be appropriately selected, but is preferably performed in the air using driers such as hot air-circulating driers.

(Image Forming Apparatus)

An image forming apparatus of the present invention includes an image bearing member; an electrostatic latent image forming unit configured to form an electrostatic latent image on the image bearing member; a developing unit configured to develop with a toner the electrostatic latent image formed on the image bearing member to thereby form a toner image; a primary transfer unit configured to primarily transfer onto an intermediate transfer belt the toner image on the image bearing member; a secondary transfer unit configured to secondarily transfer onto a recording medium the toner image on the intermediate transfer belt; and a fixing unit configured to fix the toner image on the recording medium; and, if necessary, further includes appropriately selected other units such as a charge-eliminating unit, a cleaning unit, a recycling unit and a controlling unit.

Preferably, the image forming apparatus is a full-color image forming apparatus where a plurality of image bearing members each having a developing unit for each color are arranged in series.

Referring to the appended figures, an intermediate transfer belt used in a belt constitution section included in the image forming apparatus of the present invention will be described in detail.

FIG. 1 shows one exemplary layer construction of an intermediate transfer belt suitably used in the present invention.

In this layer construction shown in FIG. 1, a flexible elastic layer 2 is formed on a relatively flexible but rigid base layer 1, and a concavo-convex pattern is formed on the elastic layer 2 by partially embedding spherical particles 3 in the elastic layer 2.

Figure 2:
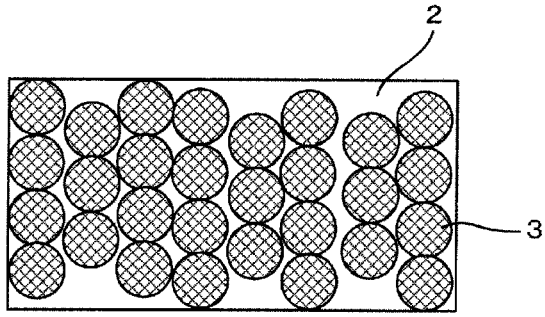
FIG. 2 is an explanatory view of one surface structure of an intermediate transfer belt of the present invention.

FIG. 2 shows one exemplary surface structure of an intermediate transfer belt suitably used in the present invention.

A surface pattern of the elastic layer is a concavo-convex pattern in which the spherical particles 3 are arranged on the elastic layer 2 to form a single layer in a plane direction.

Figure 4:
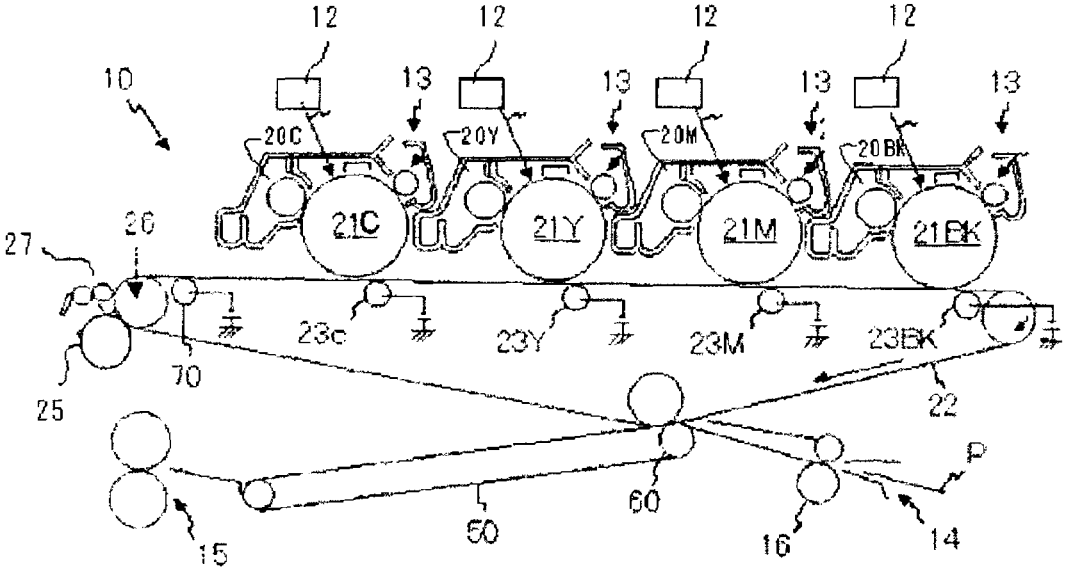
FIG. 4 schematically illustrates one exemplary image forming apparatus.

FIG. 4 is one exemplary schematic view of essential parts for describing an image forming apparatus (color copier) of the present invention including as a belt member an intermediate transfer belt of the present invention.

The image forming apparatus shown in FIG. 4 is one exemplary schematic view of essential parts for describing an image forming apparatus in which a plurality of photoconductor drums are serially arranged along an intermediate transfer belt.

This figure shows one exemplary configuration of a four-drum digital color printer having four photoconductor drums (21Bk, 21Y, 21M and 21C) for forming toner images of four different colors (black, yellow, magenta and cyan).

In FIG. 4, main body of a printer 10 is composed of image writing sections 12, image forming sections 13 and paper feeding sections 14, for electrophotographic color image formation. Based on image signals, image processing operation is performed in an image processing section, and converted to color signals of black (Bk), magenta (M), yellow (Y) and cyan (C) for image formation, and then the color signals are transmitted to the image writing sections 12. The image writing sections 12 are laser scanning optical systems each including a laser light source, a deflector such as a rotary polygon mirror, a scanning imaging optical system, and a group of mirrors, and have four optical writing paths corresponding to the color signals, and perform image writing corresponding to respective color signals on image bearing members (photoconductors) (21Bk, 21M, 21Y and 21C) provided for respective colors in the image forming sections. Notably, in FIG. 4, a numerical reference 26 denotes a belt driven roller, and numerical reference 70 denotes a bias roller.

The image forming sections 13 includes four photoconductors (21Bk, 21M, 21Y and 21C) serving as image bearing members for black (Bk), magenta (M), yellow (Y) and cyan (C). Generally, organic photoconductors (OPCs) are used as these photoconductors. On a transfer belt 22 of each of the photoconductors (21Bk, 21M, 21Y and 21C), each of the photoconductors (21Bk, 21M, 21Y and 21C), and around each of the primary transfer bias, a charging unit, an exposure portion irradiated with laser beam from the image writing section 12, a developing unit for black, magenta, yellow or cyan (20Bk, 20M, 20Y or 20C), a primary transfer bias roller (23Bk, 23M, 23Y or 23C) serving as a primary transfer unit, a cleaning unit (not shown), and a charge-eliminating unit for the photoconductor (not shown) are arranged. Each of the developing units (20Bk, 20M, 20Y and 20C) employs a two component magnet brush developing method. A belt constitution section is located between intermediate rollers 23Bk, 23M, 23Y and 23C. The color toner images formed on the photoconductors are sequentially superposingly transferred.

The transfer paper P fed from the paper feeding section 14 is fed via a registration roller 16 and then held by a transfer conveyance belt 50 as a belt constitution section. The toner images transferred onto the intermediate transfer belt 22 are secondarily transferred (collectively transferred) to the transfer paper P by a secondary transfer bias roller 60 serving as a secondary transfer unit at a point in which the intermediate transfer belt 22 is brought into contact with the transfer conveyance belt 50. Thus, a color image is formed on the transfer paper P. The transfer paper P on which the color image is formed is fed to a fixing unit 15 via the transfer conveyance belt 50, and the color image is fixed on the transfer paper P by the fixing unit 15, and then the transfer paper P is discharged from the main body of the printer.

Residual toner remaining on the surface of the intermediate transfer belt 22, which has not been transferred in the secondary transfer process, are removed by a belt cleaning unit 25 from the intermediate transfer belt 22. Downstream of the belt cleaning unit 25 with respect to the rotation direction of the intermediate transfer belt, a lubricant applying unit 27 is provided. The lubricant applying unit 27 includes a solid lubricant and a conductive brush configured to rub the intermediate transfer belt 22 so as to apply the solid lubricant to the surface of the intermediate transfer belt. The conductive brush is constantly in contact with the intermediate transfer belt 22, so as to apply the solid lubricant to the intermediate transfer belt 22. The solid lubricant is effective to improve the cleanability of the intermediate transfer belt 22, thereby preventing occurrence of filming thereon, and improving durability of the intermediate transfer belt.

Examples of the lubricant include zinc stearate, calcium stearate, zinc palmitate, zinc laurate, stearic acid, palmitic acid, and lauric acid. Of these, particularly preferred is zinc stearate.

Notably, the intermediate transfer belt of the present invention can be suitably applied to an image forming apparatus employing an intermediate transfer belt system which includes the above described intermediate transfer belt 22, as well as an image forming apparatus employing a transfer conveyance belt system which includes a transfer conveyance belt instead of the intermediate transfer belt 22. The image forming apparatus employing the transfer conveyance belt system can employ both of the one photoconductor drum system and the four photoconductor drum system.

EXAMPLES

The present invention will next be described by way of Examples and Comparative Examples. The present invention, however, should not be construed as being limited to the Examples.

Example 1

Production of Intermediate Transfer Belt

Preparation of Base Layer-Coating Liquid

First, carbon black (SPECIAL BLACK 4, product of Evonik Degussa) was dispersed in N-methyl-2-pyrrolidone with a bead mill. The resultant dispersion liquid was added to polyimide varnish mainly containing a polyimide resin precursor (U-VARNISH A, product of UBE INDUSTRIES, LTD.) so that the carbon black content was adjusted to 17% by mass of the solid content of polyamic acid, followed by thoroughly stirring and mixing, to thereby prepare a base layer-coating liquid.

—Formation of Base Layer—

Next, a metal cylinder (outer diameter: 340 mm, length: 300 mm) was subjected to blast treatment so as to have a rough surface, and then used as a mold. While the resultant cylindrical mold was being rotated at 50 rpm, the above base layer-coating liquid was uniformly flow-cast over the outer surface of the cylindrical mold using a dispenser. At the point when all of a predetermined amount of the coating liquid was flow-cast and then uniformly spread on the outer surface of the cylindrical mold, the rotation speed was increased to 100 rpm. The resultant cylindrical mold was placed in a hot air-circulating drier, and gradually heated to 110° C., followed by heating for 60 min. Moreover, the cylindrical mold was further heated to 200° C., followed by heating for 20 min. Subsequently, the rotation was stopped, and then the cylindrical mold was gradually cooled and taken out from the drier. Thereafter, the cylindrical mold was placed in a heating furnace (baking furnace) which could perform high-temperature treatment, and was heated (baked) stepwise to 320° C., followed by heating (baking) for 60 min and thoroughly cooled to thereby form a polyimide endless belt (base layer).

The resultant base layer had an average thickness of 60 μm. Notably, the thickness of the base layer was measured using an electric micrometer KG3001A (product of ANRITSU CORPORATION).

—Preparation of Elastic Layer-Coating Liquid—

The materials described below were mixed together, thoroughly kneaded with a twin-screw kneader, and then dissolved into a solvent (2-heptanone, product of KYOWA HAKKO CHEMICAL CO., LTD.) so as to have the solid concentration of 40% by mass to thereby prepare an elastic layer-coating liquid.

| | |
|---|---|
| Acrylic rubber (trade name: NIPOL AR12, product of ZEON CORPORATION) | 100 parts by mass |
| Stearic acid (trade name: STEARIC ACID, product of Hiroshima Wako Co., Ltd.) | 1 part by mass |

-continued

| | |
|---|---|
| Hexane diamine carbamate (trade name: DIAK No. 1, product of Dupont) | 0.6 parts by mass |
| Diazabicycloundecene (DBU) (trade name: ACT55, product of Safic-Alcan Deutschland GmbH) | 0.6 parts by mass |
| Red phosphorus (trade name: NOVAEXCEL, product of RIN KAGAKU KOGYO Co., Ltd.) | 10 parts by mass |
| Aluminium hydroxide (HIGILITE H42M, product of Showa Denko K.K.) | 60 parts by mass |
| Tetrabutylammonium perchlorate (QAP-01, product of Japan Carlit Co., Ltd.) | 0.1 parts by mass |

—Formation of Elastic Layer on Base Layer—

The above elastic layer-coating liquid was uniformly flow-cast on an outer surface of the above-formed polyimide base layer with a dispenser while the metal mold was being rotated. The coating amount was set so that the final layer thickness was adjusted to 500 μm. Thereafter, the metal mold was placed in a hot air-circulating drier while being rotated. Then, the metal mold was heated to 90° C. at a temperature increasing rate of 4° C./min, followed by heating (drying) for 30 min. After the metal mold had been removed from the drier and cooled to room temperature, silicone spherical particles "TOSPEARL 120" (volume average particle diameter: 2.0 μm, product of Momentive Performance Materials Inc.) were uniformly applied to the surface thereof. Then, a polyurethane rubber blade (serving as the press member) was pressed against the particles to fix the particles on the elastic layer using a device shown in FIG. 3. Then, a heat treatment (vulcanization) was performed at 170° C. for 60 min using a hot air-circulating drier. A particle layer was formed by arranging spherical particles on the elastic layer in a plane direction and forming a concavo-convex pattern to thereby obtain an intermediate transfer belt.

—Post-Cure Treatment (Heat Treatment)—

Then, post-vulcanized intermediate transfer belt was subjected to a post-cure treatment at 170° C. for 5 hours using a hot air-circulating drier. Thus, the intermediate transfer belt of Example 1 which was an endless belt was produced.

Example 2

Production of Intermediate Transfer Belt

The intermediate transfer belt of Example 2 which was an endless belt was produced in the same manner as in Example 1, except that the post-vulcanized intermediate transfer belt was subjected to a post-cure treatment at 180° C. for 4 hours.

Example 3

Production of Intermediate Transfer Belt

The intermediate transfer belt of Example 3 which was an endless belt was produced in the same manner as in Example 1, except that the post-vulcanized intermediate transfer belt was subjected to a post-cure treatment at 160° C. for 6 hours.

Example 4

Production of Intermediate Transfer Belt

The intermediate transfer belt of Example 4 which was an endless belt was produced in the same manner as in Example 1, except that the elastic layer was formed by means of the elastic layer-coating liquid having the following composition, and the post-vulcanized intermediate transfer belt was subjected to a post-cure treatment at 150° C. for 15 hours.

—Preparation of Elastic Layer-Coating Liquid—

The materials described below were mixed together, thoroughly kneaded with a twin-screw kneader, and then dissolved into a solvent (2-butanone, product of KYOWA HAKKO CHEMICAL CO., LTD.) so as to have the solid concentration of 40% by mass to thereby prepare an elastic layer-coating liquid.

| | |
|---|---|
| Hydrogenated nitrile rubber (trade name: ZETPOL 2020L, product of ZEON CORPORATION) | 100 parts by mass |
| Stearic acid (trade name: STEARIC ACID, product of Hiroshima Wako Co., Ltd.) | 1 part by mass |
| Sulfur (trade name: 200 MESH SULFUR, product of TsurumiChemical Industry Co., Ltd.) | 1 part by mass |
| Zinc oxide (trade name: ZINC OXIDE II, product of SEIDO CHEMICAL INDUSTRY CO., LTD.) | 5 parts by mass |
| Tetramethylthiuram monosulphide (trade name: NOCCELER TS, product of OUCHI SHINKO CHEMICAL INDUSTRIAL CO., LTD) | 0.5 parts by mass |
| Red phosphorus (trade name: NOVAEXCEL, product of RIN KAGAKU KOGYO Co., Ltd.) | 10 parts by mass |
| Aluminium hydroxide (HIGILITE H42M, product of Showa Denko K.K.) | 40 parts by mass |

Example 5

Production of Intermediate Transfer Belt

The intermediate transfer belt of Example 5 which was an endless belt was produced in the same manner as in Example 1, except that lauric acid (special grade, product of Wako Pure Chemical Industries, Ltd.) was used instead of stearic acid in the elastic layer-coating liquid.

Example 6

Production of Intermediate Transfer Belt

The intermediate transfer belt of Example 6 which was an endless belt was produced in the same manner as in Example 1, except that myristic acid (special grade, product of Wako Pure Chemical Industries, Ltd.) was used instead of stearic acid in the elastic layer-coating liquid.

Example 7

Production of Intermediate Transfer Belt

The intermediate transfer belt of Example 7 which was an endless belt was produced in the same manner as in Example 1, except that palmitic acid (special grade, product of Wako Pure Chemical Industries, Ltd.) was used instead of stearic acid in the elastic layer-coating liquid.

Comparative Example 1

Production of Intermediate Transfer Belt

The intermediate transfer belt of Comparative Example 1 which was an endless belt was produced in the same manner as in Example 1, except that the post-vulcanized intermediate transfer belt was subjected to a post-cure treatment at 180° C. for 2 hours.

Comparative Example 2

Production of Intermediate Transfer Belt

The intermediate transfer belt of Comparative Example 2 which was an endless belt was produced in the same manner as in Example 1, except that the post-vulcanized intermediate transfer belt was subjected to a post-cure treatment at 170° C. for 3 hours.

Comparative Example 3

Production of Intermediate Transfer Belt

The intermediate transfer belt of Comparative Example 3 which was an endless belt was produced in the same manner as in Example 1, except that the post-vulcanized intermediate transfer belt was subjected to a post-cure treatment at 160° C. for 4 hours.

Comparative Example 4

Production of Intermediate Transfer Belt

The intermediate transfer belt of Comparative Example 4 which was an endless belt was produced in the same manner as in Example 4, except that the post-vulcanized intermediate transfer belt was subjected to a post-cure treatment at 150° C. for 6 hours.

Comparative Example 5

Production of Intermediate Transfer Belt

The intermediate transfer belt of Comparative Example 5 which was an endless belt was produced in the same manner as in Example 1, except that the post-vulcanized intermediate transfer belt was not subjected to a post-cure treatment.

Comparative Example 6

Production of Intermediate Transfer Belt

The intermediate transfer belt of Comparative Example 6 which was an endless belt was produced in the same manner as in Example 1, except that the elastic layer was formed on the base layer as follows.

—Formation of Elastic Layer on Base Layer—

The above elastic layer-coating liquid of Example 1 was uniformly flow-cast on an outer surface of the above-formed polyimide base layer with a dispenser while the metal mold was being rotated. The coating amount was set so that the final layer thickness was adjusted to 500 μm. Thereafter, the metal mold was placed in a hot air-circulating drier while being rotated. Then, the metal mold was heated to 90° C. at a temperature increasing rate of 4° C./min, followed by heating (drying) for 30 min. After the metal mold had been removed from the drier and cooled to room temperature, a heat treatment (vulcanization) was performed at 170° C. for 60 min using a hot air-circulating drier to thereby obtain an intermediate transfer belt.

Comparative Example 7

Production of Intermediate Transfer Belt

The intermediate transfer belt of Comparative Example 7 which was an endless belt was produced in the same manner as in Comparative Example 6, except that the post-vulcanized intermediate transfer belt was subjected to a post-cure treatment at 170° C. for 3 hours.

Comparative Example 8

Production of Intermediate Transfer Belt

The intermediate transfer belt of Comparative Example 8 which was an endless belt was produced in the same manner as in Example 1, except that the post-vulcanized intermediate transfer belt was subjected to a post-cure treatment at 180° C. for 24 hours.

Next, thus produced intermediate transfer belts of Examples and Comparative Examples were measured for microrubber hardness and content of fatty acid, accelerated tested for blooming, and evaluated for energizing fatigue as follows. Results are shown in Tables 1-1 to 1-4.

<Microrubber Hardness>

The microrubber hardness was measured by a microrubber hardness meter (MD-1, product of KOBUNSHI KEIKI CO., LTD.) under an environment of 25° C. and 50% RH.

<Measurement Method of Amount of Fatty Acid>

(1) Each of the prepared intermediate transfer belts were cut into about 1 cm×1 cm, and an elastic layer portion was peeled therefrom. The peeled elastic layer portion was weighed and immersed into 6 mL of methanol in a sealed vessel with a cap for 24 hours to extract a fatty acid from the elastic layer of the intermediate transfer belt.

(2) To the vessel, was added 2 mL of methanol hydrochloride (0.5 mol/L), followed by sealing the vessel with the cap again and heating at 80° C. for 2 hours in the vessel to thereby methylesterify the fatty acid. Thus, an extract of the elastic layer of the intermediate transfer belt was obtained.

(3) The resultant extract was objected to GC-MS measurement.

The GC-MS measurement was performed using GC-MS2010 (product of SHIMADZU CORPORATION) in the total ion mode in order to identify the fatty acid contained in the extract to thereby select an ion used. Then, the fatty acid was quantified in the SIM (selected ion monitor) mode.

A standard curve was drawn based on the area of the chromatogram in the SIM mode using a reagent corresponding to the detected fatty acid (a reagent of stearic acid, lauric acid, myristic acid, or palmitic acid having a purity of 99% or more).

(4) The amount of the fatty acid contained in the extract of the elastic layer of the intermediate transfer belt was determined from the standard curve. Based on the amount, the amount of the fatty acid (parts by mass) relative to 100 parts by mass of the elastic layer ingredient was calculated.

<Accelerated Test of Blooming>

Each of the produced intermediate transfer belts was cut into 10 cm×10 cm, stored at 45° C. and 90% RH for 1 day, and then immersed into water at 23° C. for 3 days, follower by visually observing for the presence or absence of occurrence of a fatty acid blooming on the surface of the intermediate transfer belt and evaluating according to the following criteria. Notably, when a fatty acid blooming is occurred, white deposit is visually observed.

[Evaluation Criteria]

A: There was no fatty acid bloom.

B: There was a little fatty acid bloom.

C: There was a fatty acid bloom.

<Image Evaluation>

Each of the produced intermediate transfer belts was mounted on the image forming apparatus shown in FIG. 4 and evaluated as follows. Results are shown in Tables 1-1 to 1-4. The toner used for the image evaluation was a toner for IMAGIO MP C5002 (product of Ricoh Company, Ltd.).

<<Measurement of Initial Transfer Rate (%)>>

The transfer paper used was paper having irregularities in its surface (LEATHAC 66, 215 kg paper). A solid blue image (Test Chart No. 5-1 from The Imaging Society of Japan) was output on the transfer paper using the image forming apparatus. Then, the amount of the toner present on the intermediate transfer belt before the toner was transferred onto the paper and the amount of the toner remaining on the intermediate transfer belt after the toner had been transferred onto the paper were measured, and a transfer rate (%) was calculated according to the following Equation (b).

$$\text{Transfer rate}(\%)=[\text{Amount of toner remaining on intermediate transfer belt after transfer}(g)/\text{Amount of toner present on intermediate transfer belt before transfer}(g)]\times 100 \quad (b)$$

Notably, the toner amount was measured as a mass change of the intermediate transfer belt before and after transfer.

<<Measurement of Transfer Rate (%) after 10,000 Sheets Continuous Printing>>

The test chart was continuously printed on 10,000 sheets, and then printing was terminated. The transfer rate (%) was measured with the same method as the Measurement of initial transfer rate.

<<Image Evaluation after 10,000 Sheets Continuous Printing>>

The test chart was continuously printed on 10,000 sheets. Then, a halftone image of monotonic cyan was printed to observe the occurrence of image failures (a decrease of image density, an ununiformily of concentration, and a local ununiformity of transfer such as black spots which is generated when an image bearing member is damaged).

<Evaluation of Energizing Fatigue>

Resistance variation after 300 applications (i.e., after fatigue) (1 application includes a 60 sec application at 1,000 V and a 10 sec stand-by) was measured using HIRESTA-UP MCP-HT450 (product of Mitsubishi Chemical Analytech Co., Ltd.). When the variation amount of the common logarithm value between initial volume resistance and post-fatigue resistance is less than 1 (Log Ω·cm), it was considered as possible (A). When the variation amount was 1 (Log Ω·cm) or more, it was considered as impossible (B).

TABLE 1-1

| | | Example 1 | Example 2 | Example 3 | Example 4 |
|---|---|---|---|---|---|
| Elastic material | | Acrylic rubber | Acrylic rubber | Acrylic rubber | Hydrogenated nitrile rubber |
| Spherical particles on surface of elastic layer | | Yes | Yes | Yes | Yes |
| Fatty acid in elastic layer | | Stearic acid | Stearic acid | Stearic acid | Stearic acid |
| Post-cure temperature (° C.) | | 170 | 180 | 160 | 150 |
| Post-cure time (hr) | | 5 | 4 | 6 | 15 |
| Fatty acid content (part(s) by mass, relative to 100 parts by mass of elastic layer ingredient) | | 0.014 | 0.007 | 0.017 | 0.016 |
| Microrubber Hardness (°) | | 26.8 | 27.1 | 26 | 30.2 |
| Occurrence of bloom | | A | A | A | A |
| Initial transfer rate (%) | | 86 | 84 | 85 | 80 |
| Transfer rate after 10,000 sheets printing (%) | | 82 | 81 | 83 | 78 |
| Image failures after 10,000 sheets printing | | None | None | None | None |
| Energizing fatigue (unit: LogR (Ω · cm)) | Initial | 10.10 | 10.08 | 10.06 | 10.02 |
| | Post-fatigue | 10.96 | 10.92 | 10.95 | 10.95 |
| | Variation amount | 0.86 | 0.84 | 0.89 | 0.93 |
| | Judgment | A | A | A | A |

TABLE 1-2

| | | Example 5 | Example 6 | Example 7 |
|---|---|---|---|---|
| Elastic material | | Acrylic rubber | Acrylic rubber | Acrylic rubber |
| Spherical particles on surface of elastic layer | | Yes | Yes | Yes |
| Fatty acid in elastic layer | | Lauric acid | Myristic acid | Palmitic acid |
| Post-cure temperature (° C.) | | 170 | 170 | 170 |
| Post-cure time (hr) | | 5 | 5 | 5 |
| Fatty acid content (part(s) by mass, relative to 100 parts by mass of elastic layer ingredient) | | 0.012 | 0.013 | 0.015 |
| Microrubber Hardness (°) | | 26.2 | 26.6 | 26.4 |
| Occurrence of bloom | | A | A | A |
| Initial transfer rate (%) | | 81 | 80 | 82 |
| Transfer rate after 10,000 sheets printing (%) | | 78 | 78 | 79 |
| Image failures after 10,000 sheets printing | | None | None | None |
| Energizing fatigue (unit: LogR (Ω · cm)) | Initial | 10.11 | 10.13 | 10.10 |
| | Post-fatigue | 10.98 | 10.96 | 10.96 |
| | Variation amount | 0.87 | 0.83 | 0.86 |
| | Judgment | A | A | A |

TABLE 1-3

| | Comparative Example 1 | Comparative Example 2 | Comparative Example 3 | Comparative Example 4 |
|---|---|---|---|---|
| Elastic material | Acrylic rubber | Acrylic rubber | Acrylic rubber | Hydrogenated nitrile rubber |
| Spherical particles on surface of elastic layer | Yes | Yes | Yes | Yes |
| Fatty acid in elastic layer | Stearic acid | Stearic acid | Stearic acid | Stearic acid |
| Post-cure temperature (° C.) | 180 | 170 | 160 | 150 |
| Post-cure time (hr) | 2 | 3 | 4 | 6 |
| Fatty acid content (part(s) by mass, relative to 100 parts by mass of elastic layer ingredient) | 0.051 | 0.054 | 0.055 | 0.082 |
| Microrubber Hardness (°) | 24.4 | 23.3 | 22.1 | 28.2 |
| Occurrence of bloom | B | B | C | C |
| Initial transfer rate (%) | 86 | 84 | 85 | 83 |
| Transfer rate after 10,000 sheets printing (%) | 65 | 63 | 58 | 55 |
| Image failures after 10,000 sheets printing | Ununiformity was observed | Ununiformity was observed | Ununiformity was observed | Ununiformity was observed |
| Energizing fatigue (unit: LogR (Ω · cm)) Initial | 10.11 | 10.13 | 10.10 | 10.12 |
| Energizing fatigue (unit: LogR (Ω · cm)) Post-fatigue | 10.72 | 10.68 | 10.61 | 10.93 |
| Energizing fatigue (unit: LogR (Ω · cm)) Variation amount | 0.61 | 0.55 | 0.51 | 0.81 |
| Energizing fatigue (unit: LogR (Ω · cm)) Judgment | A | A | A | A |

TABLE 1-4

| | Comparative Example 5 | Comparative Example 6 | Comparative Example 7 | Comparative Example 8 |
|---|---|---|---|---|
| Elastic material | Acrylic rubber | Acrylic rubber | Acrylic rubber | Acrylic rubber |
| Spherical particles on surface of elastic layer | Yes | No | No | Yes |
| Fatty acid in elastic layer | Stearic acid | Stearic acid | Stearic acid | Stearic acid |
| Post-cure temperature (° C.) | None | 170 | 170 | 180 |
| Post-cure time (hr) | None | 5 | 3 | 24 |
| Fatty acid content (part(s) by mass, relative to 100 parts by mass of elastic layer ingredient) | 0.15 | 0.014 | 0.054 | 0.0005 |
| Microrubber Hardness (°) | 22.1 | 26.6 | 24.5 | 32.1 |
| Occurrence of bloom | C | A | C | C |
| Initial transfer rate (%) | 84 | 45 | 44 | 64 |
| Transfer rate after 10,000 sheets printing (%) | 50 | 43 | 42 | 62 |
| Image failures after 10,000 sheets printing | Ununiformity was observed | Image density was low | Ununiformity was observed | Ununiformity was observed |
| Energizing fatigue (unit: LogR (Ω · cm)) Initial | 10.11 | 10.12 | 10.12 | 10.10 |
| Energizing fatigue (unit: LogR (Ω · cm)) Post-fatigue | 10.62 | 10.72 | 10.71 | 11.31 |
| Energizing fatigue (unit: LogR (Ω · cm)) Variation amount | 0.51 | 0.60 | 0.61 | 1.21 |
| Energizing fatigue (unit: LogR (Ω · cm)) Judgment | A | A | A | B |

Embodiments of the present invention as follows:

<1> An intermediate transfer belt including:

a base layer; and an elastic layer on the base layer containing spherical particles on a surface thereof and containing an elastic layer ingredient, wherein the elastic layer contains a fatty acid in an amount of 0.001 parts by mass to 0.040 parts by mass relative to 100 parts by mass of the elastic layer ingredient.

<2> The intermediate transfer belt according to <1>, wherein the elastic layer is an outermost layer.

<3> The intermediate transfer belt according to <1> or <2>, wherein the surface of the elastic layer has a concavo-convex pattern formed by arranging the spherical particles in a plane direction.

<4> The intermediate transfer belt according to any one of <1> to <3>, wherein the fatty acid is lauric acid, myristic acid, palmitic acid, stearic acid, or any combination thereof.

<5> The intermediate transfer belt according to any one of <1> to <4>, wherein the elastic layer ingredient contains an elastic material, and wherein the elastic material is either one or both of acrylic rubber and hydrogenated nitrile rubber.

<6> The intermediate transfer belt according to any one of <1> to <5>, wherein the base layer contains a resin and the resin is a polyimide resin or a polyamideimide resin.

<7> The intermediate transfer belt according to any one of <1> to <6>, wherein the intermediate transfer belt has a microrubber hardness of 60° or less.

<8> A method for producing the intermediate transfer belt according to any one of <1> to <7> including:

forming an elastic layer which contains spherical particles on a surface thereof by coating a base layer with an elastic layer-coating liquid containing an elastic layer ingredient, followed by applying the spherical particles thereon; and heat-treating the elastic layer by vulcanizing and then heating.

<9> The method for producing an intermediate transfer belt according to <8>, wherein the heat-treating is performed under any of the following conditions: at 150° C. or more but less than 155° C. for 8 hours or more, at 155° C. or more but less than 165° C. for 5 hours or more, at 165° C. or more but less than 175° C. for 4 hours or more, and at 175° C. to 180° C. for 3 hours or more.

<10> An image forming apparatus including:

an image bearing member;

an electrostatic latent image forming unit configured to form an electrostatic latent image on the image bearing member;

a developing unit configured to develop with a toner the electrostatic latent image formed on the image bearing member to thereby form a toner image;

a primary transfer unit configured to primarily transfer onto an intermediate transfer belt the toner image on the image bearing member;

a secondary transfer unit configured to secondarily transfer onto a recording medium the toner image on the intermediate transfer belt; and a fixing unit configured to fix the toner image on the recording medium, wherein the intermediate transfer belt is the intermediate transfer belt according to any one of <1> to <7>.

This application claims priority to Japanese application No. 2012-203987, filed on Sep. 18, 2012 and Japanese application No. 2013-130485, filed on Jul. 21, 2013, and incorporated herein by reference.

What is claimed is:

1. A method for producing an intermediate transfer belt comprising:

forming an elastic layer which contains spherical particles on a surface thereof by coating a base layer with an elastic layer-coating liquid containing one or more elastic layer ingredients, followed by applying the spherical particles thereon; and heat-treating the elastic layer by vulcanizing and then heating, wherein, after the vulcanizing and heating of the elastic layer, a fatty acid content in the elastic layer is in an amount of 0.001 parts by mass to 0.040 parts by mass relative to 100 parts by mass of the one or more elastic layer ingredients, wherein the elastic layer further contains a fatty acid in an amount of 0.001 parts by mass to 0.040 parts by mass relative to 100 parts by mass of the one or more elastic layer ingredients, and wherein the one or more elastic layer ingredients contains an elastic material, and the elastic material is acrylic rubber.

2. The method for producing an intermediate transfer belt according to claim 1, wherein the heat-treating is performed under any of the following conditions: at 150° C. or more but less than 155° C. for 8 hours or more, at 155° C. or more but less than 165° C. for 5 hours or more, at 165° C. or more but less than 175° C. for 4 hours or more, and at 175° C. to 180° C. for 3 hours or more.

* * * * *